US006810824B2

(12) United States Patent
Durville

(10) Patent No.: US 6,810,824 B2
(45) Date of Patent: Nov. 2, 2004

(54) SEWING OR EMBROIDERY MACHINE

(75) Inventor: Gérard Durville, Gipf-Oberfrick (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 10/447,870

(22) Filed: May 29, 2003

(65) Prior Publication Data

US 2003/0221601 A1 Dec. 4, 2003

(30) Foreign Application Priority Data

May 30, 2002 (CH) ..... 0893/02

(51) Int. Cl.[7] ..... D05B 45/00; D05B 59/02
(52) U.S. Cl. ..... 112/278; 200/61.16
(58) Field of Search ..... 112/278, 273; 250/559.4, 559.43; 200/61.16, 61.15, 61.18

(56) References Cited

U.S. PATENT DOCUMENTS 5,103,750 A * 4/1992 Sato et al. ..... 112/278
6,564,733 B2 * 5/2003 Butzen et al. ..... 112/273

FOREIGN PATENT DOCUMENTS

| | | |
|---|---|---|
| DE | 3046260 | 6/1982 |
| WO | WO82/04447 | 12/1982 |

* cited by examiner

*Primary Examiner*—Peter Nerbun
(74) *Attorney, Agent, or Firm*—Volpe and Koenig, P.C.

(57) ABSTRACT

Monitoring of the rotation speed and stationary state of the lower thread bobbin in a sewing machine is performed using a light emitter and two reflected light receivers. The light rays reflected at the surface of the front flange of the bobbin are incident in a sequence which differs in time on the reflected light receivers. These data are evaluated by a computer, which can be the computer of the sewing machine, and are used to stop the machine or the sewing process before the thread end leaves the stitch plate of the sewing machine. It can also be determined from the observed direction of rotation of the bobbin whether the bobbin is correctly placed in the bobbin housing. From the relationship of kind of stitch, stitch speed, and bobbin rotation speed, the bobbin thread supply can also be calculated.

8 Claims, 5 Drawing Sheets

38'
38''
19
21
39
F
37
37'
37''
36
41'
41''
43'
43''
V
40

21
41'''
37''
41''
37'

21
37''
41''
19

21
41''
43''
43'
41'
19
37'
37''
36
37
35

41'
37'

SEWING OR EMBROIDERY MACHINE

BACKGROUND

The invention relates to a sewing or embroidery machine with a gripper which can be driven by a drive motor and with a lower thread bobbin rotatably mounted in the gripper for receiving a lower thread supply, with a hollow cylindrical arbor and annular flanges set on the arbor ends, of which at least one has perforations therethrough, or is provided with non-reflecting markings. More particulary, the invention relates to such sewing or embroidery machines which further include a light source and two photosensors for receiving the light rays emitted from the light source at two spaced-apart places, and a calculating and control unit for processing the signals supplied by the photosensors.

When sewing or embroidering with a sewing machine, it is known that two threads, the upper thread and the lower thread, are looped together. The upper thread, also termed the needle thread, is supplied from a spool whose size is substantially freely selectable, on or near the sewing machine. The lower thread is wound on a bobbin which is inserted within the rotatably mounted and drivable hook of the sewing machine and is freely rotatable there. The maximum size of the lower thread bobbin is thus determined by the maximum size of the hook within which it is situated. The amount of lower thread, or the lower thread supply, is in this case very much smaller than the upper thread supply located on the externally arranged spool, and moreover the lower thread bobbin is not visible from outside during sewing, since it is situated within the hook housing, which in turn is within the sewing machine. For this reason, monitoring of the current lower thread supply, the lower thread takeoff and the thread end during the embroidery or sewing process is difficult. Matters are complicated when the operator winds another thread onto an already partially filled lower thread bobbin. This other thread is not connected to that already present on the bobbin. No further sewing can be performed after this outer thread supply has been used up, although, for example, known sensors show that the bobbin core is still 50% or 70% full.

Measuring devices are already known in the prior art which seek to determine the end and/or the residual amount of the lower thread on the lower thread bobbin and which stop the sewing machine before the end of the lower thread is drawn through the sewn goods and before stitches are sewn which are consequently not held by a lower thread on the underside of the sewn goods.

From WO 82/04447, a device is known for detecting the thread end on a lower thread bobbin of a sewing machine. A light source emits a light ray substantially radially from outside through an opening in the hook housing in the direction of the rotation axis of the hook and the lower thread bobbin placed therein. Two photosensors are arranged spaced apart and tangentially offset from the light source and likewise directed substantially toward the rotation axis of the hook and of the lower thread bobbin, and are situated over a suitable aperture in the gripper housing. Flat places are formed on the core of the lower thread bobbin, and their surface is polished so that light rays directed from the light source toward the core of the lower thread bobbin are reflected at the flat places and the reflected rays can be successively received by the two photosensors as the empty bobbin rotates. As long as a thread supply is present on the bobbin, no reflection of light rays takes place. This is interpreted by the machine control to the effect that the sewing process can continue, because thread is still available. As soon as the thread is used as far as a single thread layer, and the light rays directed from the light source onto the bobbin can be reflected at the core or at the flat places and received by the photosensors, the machine control then detects the immediately approaching thread end. At the same time, it detects in which direction of rotation the lower thread bobbin is driven by the thread being taken off, in that the reflected rays reach the two photosensors, which are arranged one behind the other, in a corresponding sequence. By means of an annular coupling inserted between the lower thread bobbin and the hook housing, the lower thread bobbin is driven by the hook in the opposite direction as soon as the thread end has left the bobbin and therefore can no longer drive it. The light rays now reach the photosensors in the reverse sequence, and this is then detected as the yarn end and the machine is stopped. A residual length of lower thread thereby remains on the sewn goods. This device indeed makes it possible to detect the thread end, but for this purpose specially made lower thread bobbins with flat places are necessary. These are not commercially obtainable. Furthermore, the hook housing has to be provided with corresponding openings, in order to allow the light rays to enter the packing space and leave it again. A further disadvantage is that both the light source and the two photosensors are exposed to a lot of fluff accumulation and can hardly be cleaned by the seamstress. The thread end cannot be detected on overwound bobbins.

From DE-A 3046260, another method and a device for automatic sewing control on sewing machines have become known, in which the thread use of the sewing thread or respectively the lower thread of the sewn seam is monitored when each single stitch is sewn and is compared with an adjustable minimum value. Such expensive length measuring devices cannot be used in household sewing machines due to space requirements, and they are therefore little used, since in household sewing machines—in contrast to industrial sewing machines—the lower thread supply present on the lower thread bobbin is not exactly known. A length measurement is consequently of no use for detecting the thread end.

SUMMARY

The object of the present invention is to provide a device with which the embroidery or sewing machine can be stopped as soon as the end of the lower thread falls below a predeterminable minimum length.

This object is attained by a sewing or embroidery machine a hook which can be driven by a drive motor and with a lower thread bobbin rotatably mounted in the hook for receiving a lower thread supply, with a hollow cylindrical arbor and annular flanges set on the arbor ends, of which at least one has perforations therethrough, or is provided with non-reflecting markings. A light source and two photosensors for receiving the light rays emitted from the light source at two spaced-apart locations are provided, as well as a calculating and control unit for processing the signals supplied by the photosensors. The light source and the two photosensors are arranged axially spaced in front of the flange with the perforations or markings, and the light rays are directed at an acute angle onto the surface of the flange situated in front. Advantageous embodiments of the invention are recited in the dependent claims.

With the sewing or embroidery machine according to the invention, the thread end of the last wound lower thread can be detected, independently of whether one or more threads are wound one on top of another on the lower thread bobbin, and the machine can be stopped in good time before the thread end leaves the stitch plate. Monitoring of a thread break or of the thread end can reliably take place independently of the make of the lower thread bobbin body.

BRIEF DESCRIPTION OF THE DRAWINGS

The invention is explained in detail using an illustrated exemplary embodiment.

DETAILED DESCRIPTION OF THE PREFERRED EMBODIMENTS

Figure 1:
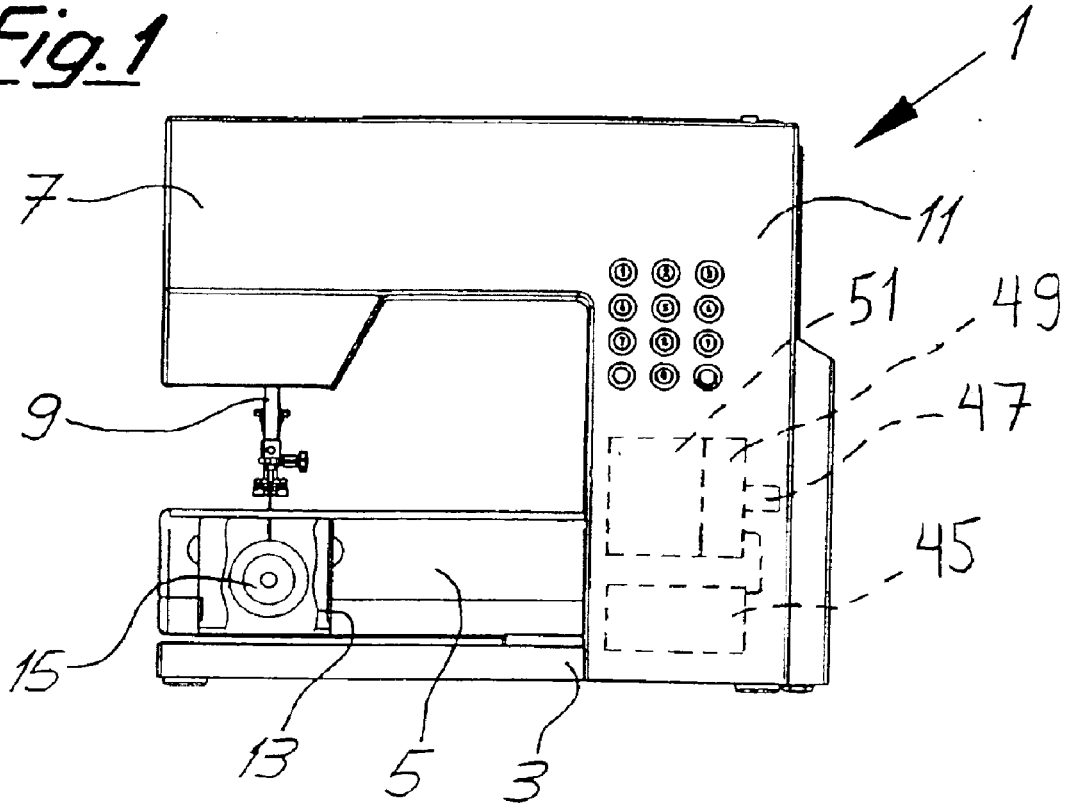
FIG. 1 shows a schematic diagram of the side view of a sewing machine with the lower arm partially broken away.
Figure 2:
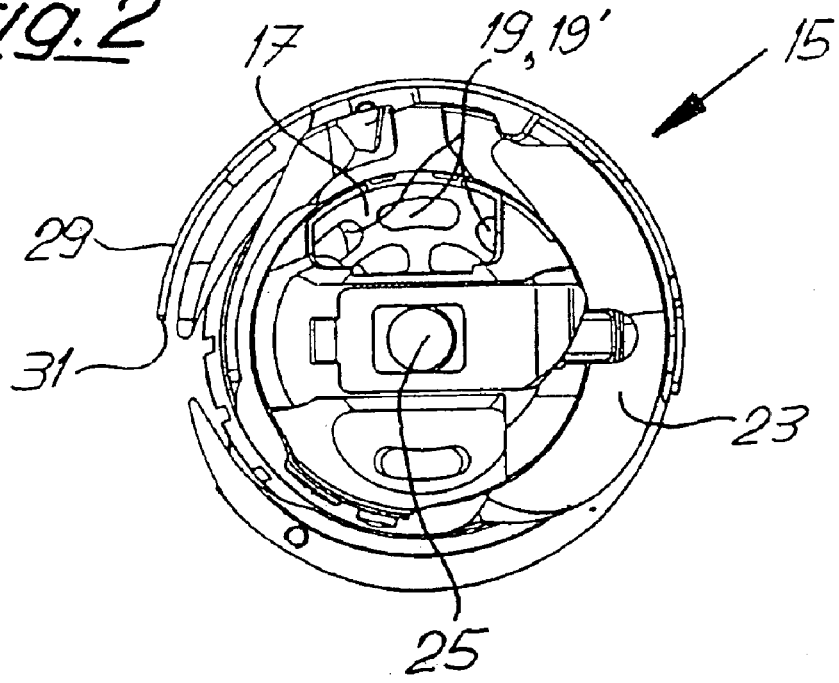
FIG. 2 shows an enlarged end view of the hook with inserted lower thread bobbin.
Figure 3:
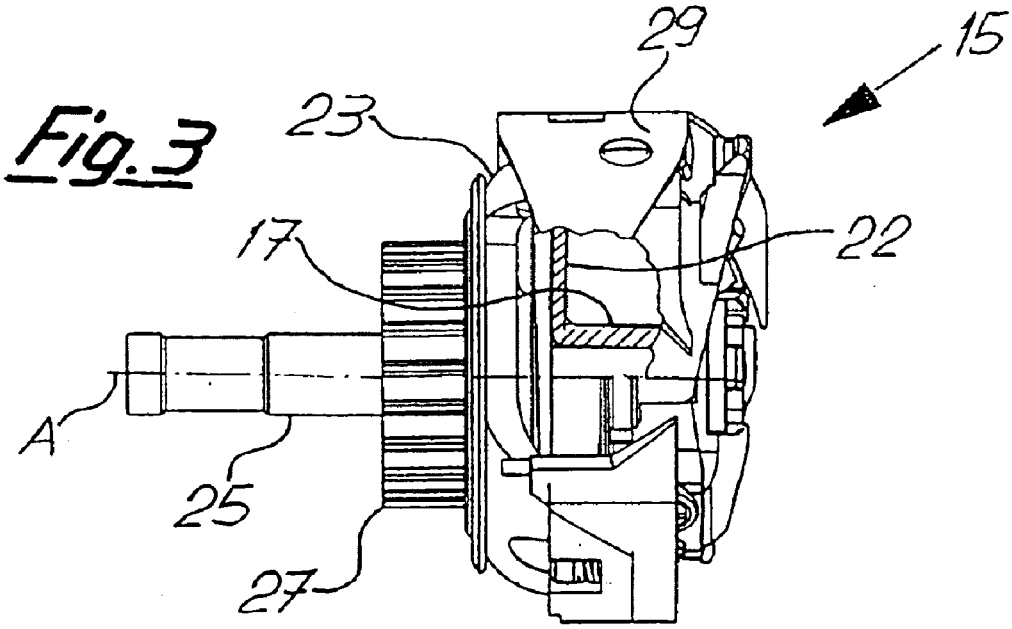
FIG. 3 shows a side view of the hook of FIG. 2.

The household sewing machine 1 shown in FIG. 1 includes a baseplate 3, a lower or free arm 5, an upper arm 7 with needle bar 9, and also the machine housing 11 in which the drive elements are accommodated. A laterally arranged cover 13 on the front end of the lower arm 5 is partially cut away in order to make the position of the hook 15 visible. A lower thread bobbin body, for short a lower thread bobbin 17, with numerous perforations 19 or non-reflecting markings 19' is inserted and visible in at least the front flange 21 in the hook 15 (FIGS. 2 and 3). The remaining portions of the commercial hook 15, such as the hook body 23, the drive shaft 25, and the pinion 27 seated on the drive shaft 25, and also the thread catching strip 29 with a tip 31 are not further described.

Figure 4:
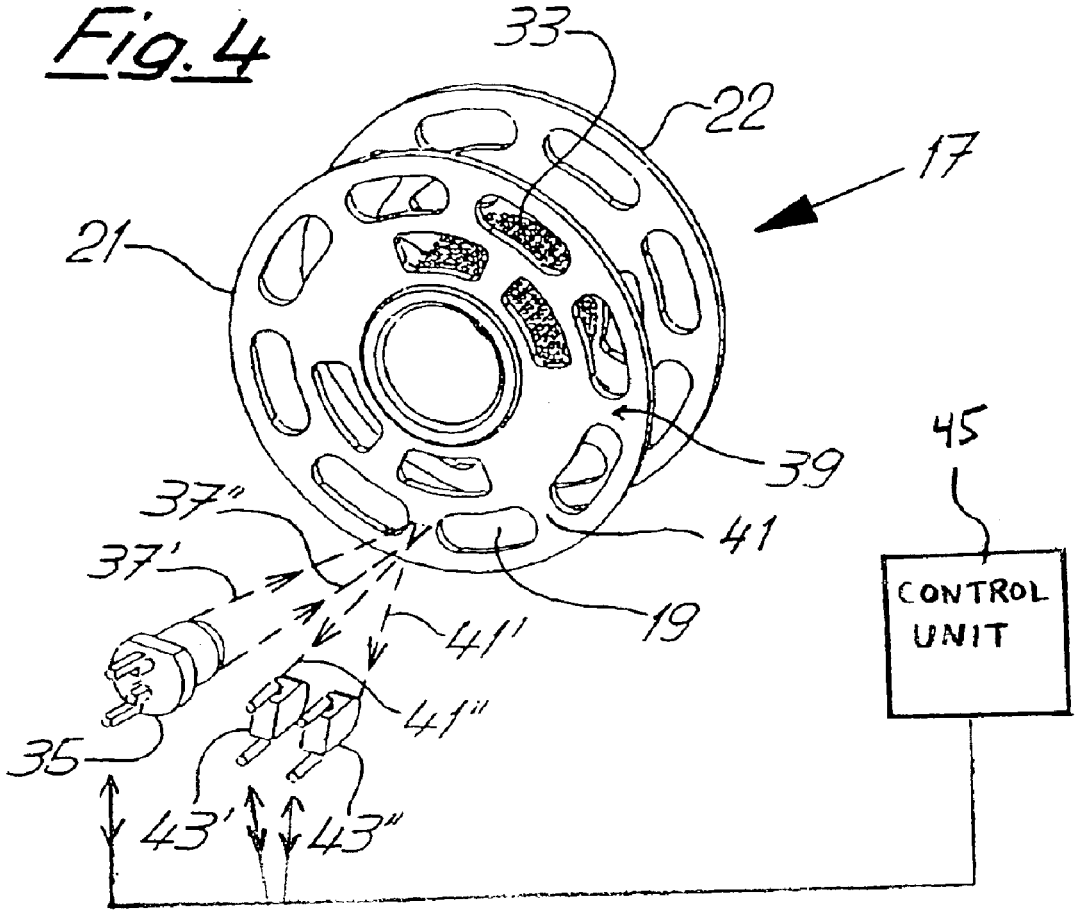
FIG. 4 shows a perspective view of the lower thread bobbin with sensors.

In FIG. 4, for better visibility, the hook 15 with the hook body 23 are omitted and only the lower thread bobbin 17 alone is shown. Visible in this Figure are also the hollow bobbin arbor or bobbin core 33, to the ends of which the two flanges 21 and 22 are fastened. The perforations 19 are formed in at least the front flange 21. They are situated concentrically of the bobbin axis A. Alternatively to the example shown, a respective one or two concentrically arranged series of holes can be present in each of flanges 21 and 22. The size, shape and number of perforations 19 is without effect on the functioning capability of the invention and hence freely selectable. The lower thread bobbin 17 can be made of metal or plastic. In connection with the present invention, it is preferably made of metal and has a polished surface at least on the front flange 21, making possible optimum reflection of a light ray directed onto it.

A light source 35 for visible or invisible light, for example an LED, is mounted at an axial spacing from the surface 39 of the front flange 21 of the bobbin 17, and directs a light ray, preferably a pulsed light ray 37, onto the front surface 39 of the flange 21, by which front surface 39 it is reflected. The reflection angle of a light ray 41' is constant as long as the ray 41' is incident on the surface region of the front flange 21 situated perpendicularly of the rotation axis of the lower thread bobbin 17 (FIG. 5A).

Figures 5A, 5B, 5C, 5D:
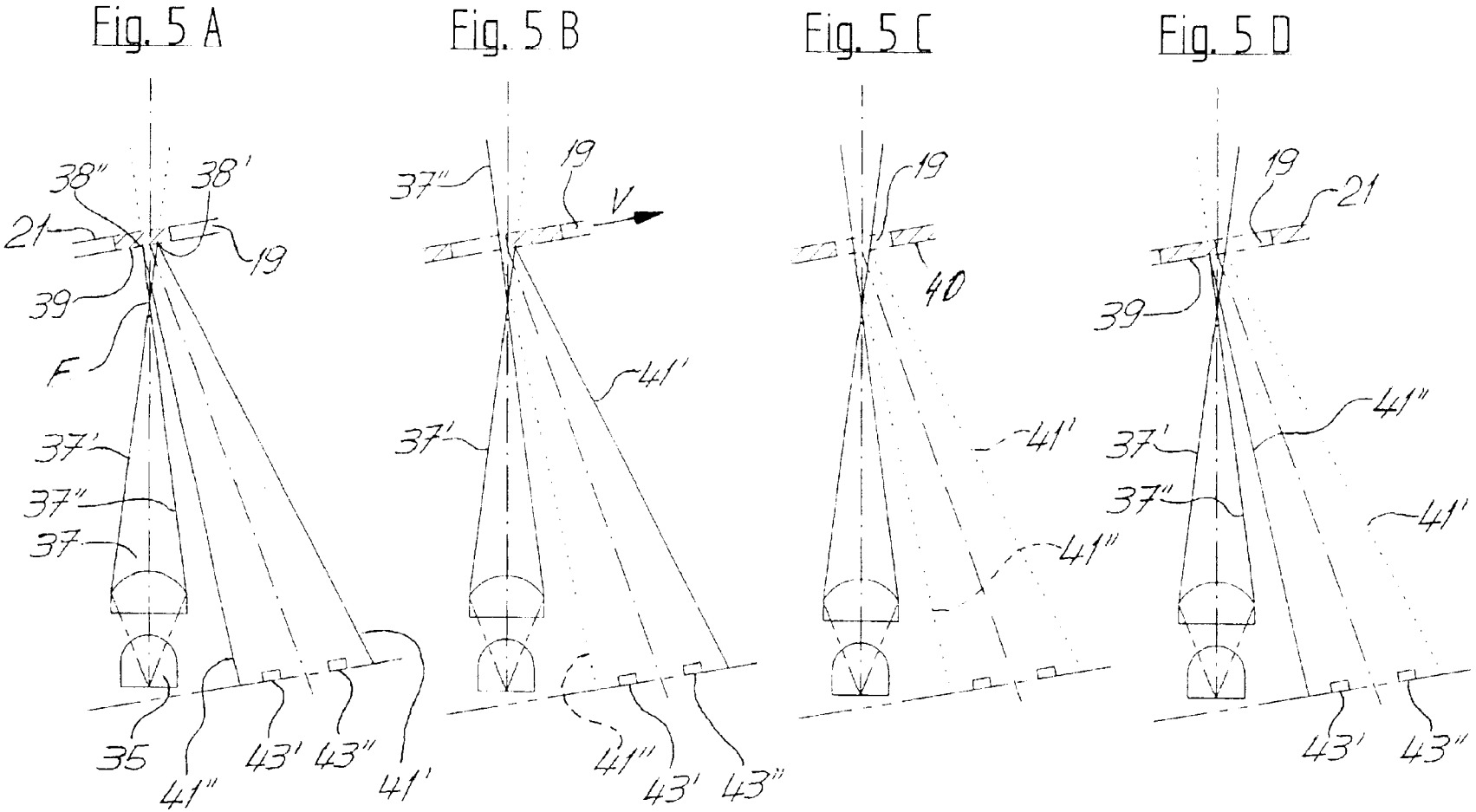
FIGS. 5A–5D show a graphical representation of the reflection of the rays of the light source to the two photosensors in four different positions of the bobbin with respect to the photosensor with a focus in front of the bobbin flange.
Figure 6D:
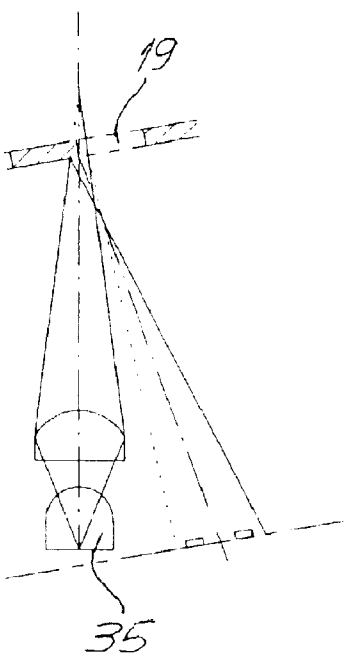
FIGS. 6A–6D show a graphical representation of the reflection of the rays of the light source to the two photosensors in four different positions of the bobbin with respect to the photosensor with a focus behind the bobbin flange.
Figure 6C:
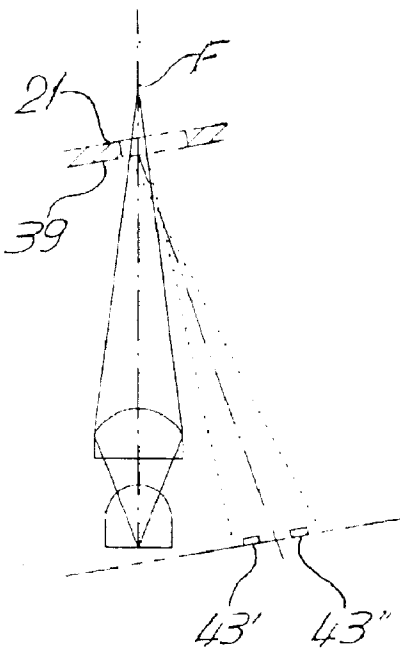
Figure 6B:
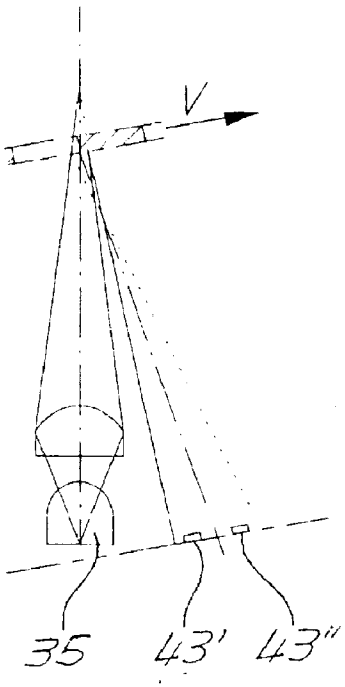
Figure 6A:
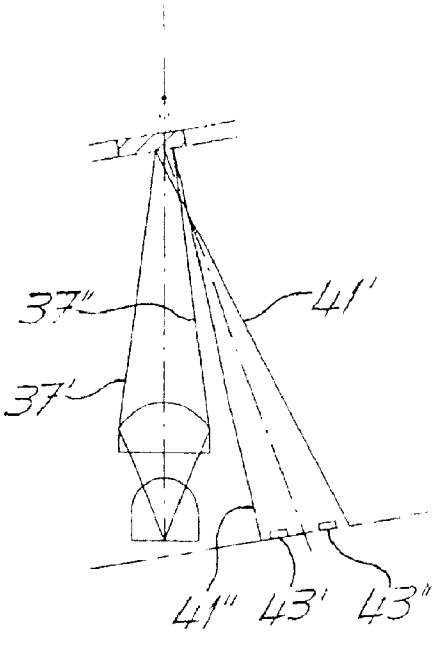

In the examples according to FIGS. 5 and 6, the light source 35 emits a conical light ray 37 at an acute angle to the surface 39 of the flange 21. In the example according to FIGS. 5A–5D, the focus F of the rays 37 is situated in front of the surface 39. The outermost light ray 37' is consequently incident at the place 38' on the surface 39 and is reflected from there as the reflected ray 41' into the receiving region of a first photosensor 43".

Photosensitive elements such as, e.g., phototransistors can be used as the photosensors.

Figures 7A, 7B, 7C, 7D:
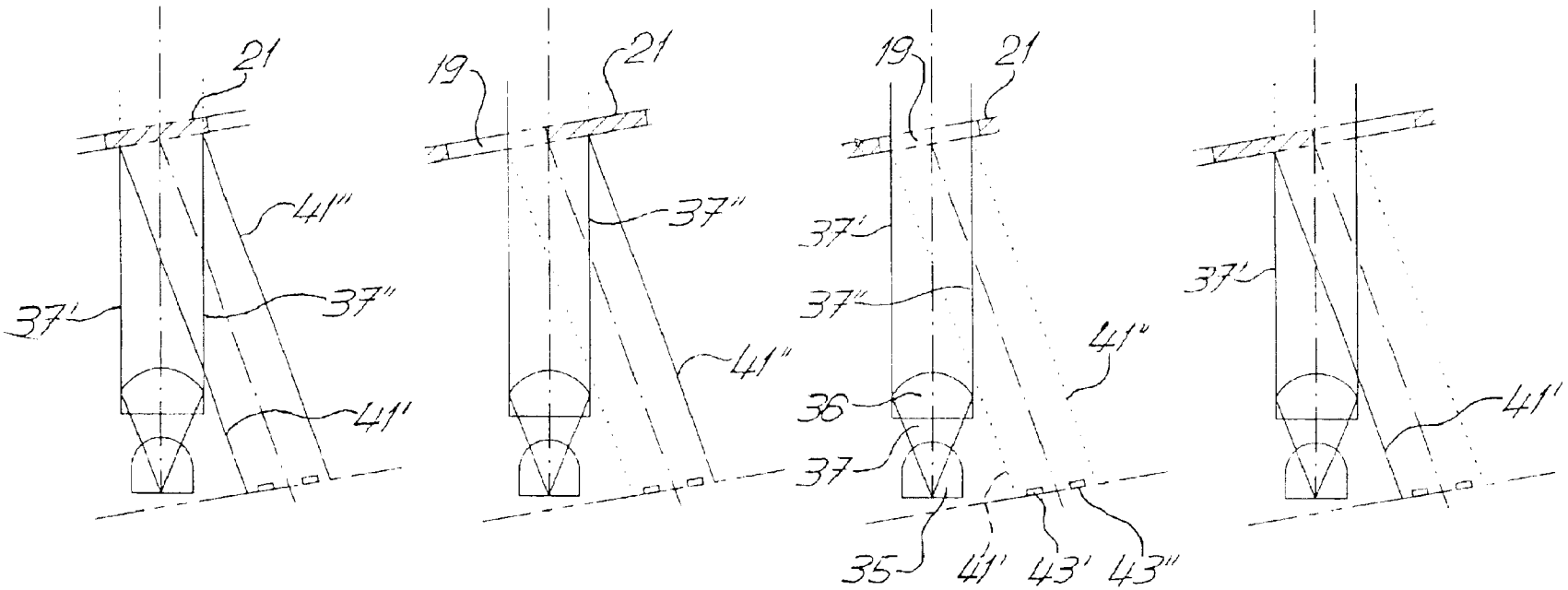
FIGS. 7A–7D show graphical representation of the reflection, with parallel rays of the light source, to the two photosensors in four different positions of the bobbin with respect to the photosensor.

The second bounding light ray 37" is reflected at the position 38" on the surface 39 and is reflected as a reflected ray 41" into the region of the second photosensor 43'. Only the respective outermost rays of the ray beams are shown in the Figures. As long as the light rays 37 consequently fall on the surface 39 formed by the webs 40 between two perforations 19, light is simultaneously received by both photosensors 43', 43". On further rotation of the bobbin 21, the light ray 37" bounding the beam is no longer incident on the surface 39, but passes through the perforation 19 or alternatively is absorbed by a marking 19' (which would be in the same location as the perforation 19 on a non-perforated bobbin as shown in FIG. 2). For the case of perforations 19, in the instance in which a thread supply is present on the bobbin behind the perforations, light is reflected on the thread. The reflection is only minimal, though, so that the reflected light ray 41" is very weak and is detected as such by the photosensor 43'. In contrast to this, the bounding light ray 37' still falls on the surface 39 and is reflected as a stronger reflected ray 41', which is correspondingly detected by the receiving portion 43". From the absence of the strong reflected light in the region of the photosensor 43', the sewing machine electronics detect the direction of rotation of the bobbin in the direction of the arrow V, from left to right in FIGS. 5, 6 and 7, and clockwise in FIG. 4. On further rotation of the bobbin 17, the two bounding light rays 37' and 37" arrive in the region of a perforation 19 or marking 19' and are consequently only weakly reflected, which is detected by the two photosensors 43' and 43" (FIG. 5C) With further rotation of the bobbin 17 or of the bobbin flange 21, the bounding ray 37" reaches the surface 39 of the web 40 situated toward the perforation 19 or marking 19'. The ray 37" is completely reflected as the bounding ray 41" to the photosensor 43', which detects it as such. The ray 37' still falling into the perforation 19 or marking 19' is only weakly reflected as ray 41' and is detected as such by the receiving portion 43". If the perforations 19 or non-reflecting markings 19' are non-reflecting markings, such markings on the bobbin flange surface may be black, for example, to allow little light reflection. Also, such markings may be positioned in any suitable manner on the bobbin flange surface.

In the embodiment of the invention according to FIGS. 6A–6D, in which the focus F is situated behind the surface 39 of the bobbin flange 21, the difference from the embodiment example of FIGS. 5A–5D is that the light rays 37' and 37" are incident on, and are reflected at, the surface 39 of the bobbin flange 21 in front of the focus. The reflected rays 41' and 41" then fall, in contrast to the example according to FIGS. 5A–5D, in the reverse order on the photosensors 43', 43". They are consequently correspondingly detected by the photosensors 43' and 43".

In the third embodiment example, according to FIGS. 7A–7D, the ray beam 37 of the light source 35 is focused into parallel light rays 37' and 37" by a correspondingly formed lens 36. The reflected rays 41' and 41" then fall on the photosensors 43' and 43", as shown in FIGS. 7A–7D.

Referring again to FIG. 4, the two photosensors 43', 43" are connected to a calculating and control unit 45 in the sewing machine 1, making possible conclusions from the time sequence of incidence of the reflected light rays 41' and 41" on the photosensors 43' and 43" about the direction of rotation of the bobbin 17 and its rotational speed $n_1$. The control unit 45 furthermore permits the detection of rotation speed changes and the stationary state of the bobbin 17. The control unit 45 is also connected to a drive shaft speed sensor 49 which determines the rotational speed no of the main shaft 47 of the drive motor 51, in order not to interpret as a thread break or thread end the stopped state of the lower thread bobbin 17 when there is an interruption of sewing.

In a preferred embodiment of the invention, the light source 35 and the two photosensors 43' and 43" are inserted next to each other in a common housing which is set on the cover 13 hinged to the lower arm 5 of the sewing machine. This arrangement makes it possible to install these elements on the existing parts (cover 13) of the sewing machine 1 without additional retaining devices and hence also without further costs, and to give access to the lower thread bobbin 17 and to these elements on opening the cover. The lenses 36 preferably placed in front of the light source 35 and the photosensors 43' and 43" can also be easily freed from fluff.

Whether the bobbin is correctly inserted into the bobbin housing can also be determined by means of the observed direction of rotation of the bobbin. The bobbin thread supply can also be calculated from the relationship of kind of stitch, stitch speed, and bobbin rotation speed.

What is claimed is:

1. A sewing or embroidery machine (1) with a hook (15) driveable by a drive motor and with a lower thread bobbin (17) rotatably mounted therein for receiving a lower thread supply, the bobbin having a hollow cylindrical arbor and annular flanges (21, 22) set on the arbor ends, of which at least one of the flanges (21) having perforations (19) therethrough, or provided with non-reflecting markings, a light source (35), which emits a light ray beam of conical shape, and two photosensors (43', 43") for receiving the light rays (37) emitted from the light source (35) at two spaced-apart locations, and a calculating and control unit (45) for processing signals supplied by the photosensors (43', 43"), wherein the light source (35) and the two photosensors (43', 43") are arranged axially spaced in front of the flange (21) with the perforations (19) or markings (19'); and the light rays (37) are directed at an acute angle onto a front surface (39) of the flange (21).

2. The sewing or embroidery machine according to claim 1, wherein a drive shaft speed sensor is connected to the control unit in order to determine a rotational speed of a main shaft of the drive motor.

3. A sewing or embroidery machine with a hook (15) driveable by a drive motor and with a lower thread bobbin (17) rotatably mounted therein for receiving a lower thread supply, the bobbin having a hollow cylindrical arbor and annular flanges (21, 22) set on the arbor ends, of which at least one of the flanges (21) having perforations (19) therethrough, or provided with non-reflecting markings, a light source (35) which emits a light ray beam (37) with parallel light rays, and two photosensors (43', 43") for receiving the light rays (37) emitted from the light source (35) at two spaced-apart locations, and a calculating and control unit (45) for processing signals supplied by the photosensors (43', 43"), wherein the light source (35) and the two photosensors (43', 43") are arranged axially spaced in front of the flange (21) with the perforations (19) or markings (19'); and the light rays (37) are directed at an acute angle onto a front surface (39) of the flange (21).

4. The sewing or embroidery machine according to claim 1, wherein the light rays of the light ray beam (37), which are incident on the surface (39) of the forward-situated flange (21) of the bobbin (17) can be reflected on the flange, and are received by only one of the two photosensors (43' or 43"), or by both of the photosensors (43', 43").

5. The sewing or embroidery machine according to claim 4, wherein an intensity and a sequence of incidences of the reflected light rays (37) on the photosensors (43', 43") is measured in dependence on a reflection at the flange surface (39) or on a smaller reflection from a thread on the bobbin (17) and visible through the perforations (19), and is evaluated by the control unit.

6. The sewing or embroidery machine according to claim 3, wherein a drive shaft speed sensor is connected to the control unit in order to determine a rotational speed of a main shaft of the drive motor.

7. The sewing or embroidery machine according to claim 3, wherein the light rays of the light ray beam (37), which are incident on the surface (39) of the forward-situated flange (21) of the bobbin (17) can be reflected on the flange, and are received by only one of the two photosensors (43' or 43"), or by both of the photosensors (43', 43").

8. The sewing or embroidery machine according to claim 7, wherein an intensity and a sequence of incidences of the reflected light rays (37) on the photosensors (43', 43") is measured in dependence on a reflection at the flange surface (39) or on a smaller reflection from a thread on the bobbin (17) and visible through the perforations (19), and is evaluated by the control unit.

* * * * *